US005908192A

United States Patent [19]

West

[11] Patent Number: 5,908,192

[45] Date of Patent: Jun. 1, 1999

[54] GOLF GAME

[76] Inventor: Robert Charles West, Turgis Court Farm, Stratfield Turgis, Basingstroke, Hampshire, RG27 OAT, United Kingdom

[21] Appl. No.: 08/973,878

[22] PCT Filed: Jul. 5, 1996

[86] PCT No.: PCT/GB96/01650

§ 371 Date: Mar. 11, 1998

§ 102(e) Date: Mar. 11, 1998

[87] PCT Pub. No.: WO97/02875

PCT Pub. Date: Jan. 30, 1997

[30] Foreign Application Priority Data

Jul. 8, 1995 [GB] United Kingdom ..... 9513966

[51] Int. Cl.[6] ..... A63F 3/00

[52] U.S. Cl. ..... 273/245

[58] Field of Search ..... 273/245, 298, 273/277, 259

[56] References Cited

U.S. PATENT DOCUMENTS

| | | | |
|---|---|---|---|
| 2,618,482 | 11/1952 | Grogan | 273/245 |
| 4,113,260 | 9/1978 | Sain | 273/245 |
| 4,134,590 | 1/1979 | Conrad | 273/245 |

FOREIGN PATENT DOCUMENTS

| | | | |
|---|---|---|---|
| 250371 | 4/1926 | United Kingdom | 273/245 |
| 1385883 | 3/1975 | United Kingdom | 273/245 |
| 2211747 | 7/1989 | United Kingdom | 273/245 |
| 2218002 | 11/1989 | United Kingdom | 273/245 |

*Primary Examiner*—Benjamin H. Layno
*Attorney, Agent, or Firm*—Nikaido, Marmelstein, Murray & Oram LLP

[57] ABSTRACT

A golf game which comprises a playing surface which has a number of areas representing holes to be played and a two-dimensional grid defining a plurality of grid references on the playing area. Markers are intended to be moved from the starting point, tee, to the finishing point, hole, a plurality of sets of cards defines optional moves of a marker in from a first point to a second point. Each set of cards corresponds to different categories of moves. The different sets of card categories generally corresponds to different types of clubs but also include bunker and rough cards. The player must use skill in order to select the next card to be played.

15 Claims, 2 Drawing Sheets

GOLF GAME

BACKGROUND OF THE INVENTION

The present invention relates to a golf game and, in particular, a golf game which involves a high level of skill and strategy in the choice of shot to be played.

In known golf games, the shot to be played is determined by die which are thrown by the player. The player throwing the highest scores would ultimately win the game. Thus, previously known golf games have generally involved a low level of skill and a high element of chance and have been most suitable for children. During a real golf game, the player has to decide between a choice of shots and choose his appropriate club, iron or putter before playing the desired shot. None of the previous golf games incorporate this skilful element of the real game of golf.

BRIEF SUMMARY OF THE INVENTION

It is one of the objects of the present invention to overcome this problem.

It is a further object of the present invention to reduce the element of chance in a golf game and increase the level of skill.

According to the present invention, there is provided a golf game comprising: a playing surface, the said playing surface having at least one playing area comprising a starting point, a finishing point and a two dimensional grid defining a plurality of grid references on the playing area incorporating the said two points; at least one marker operable to be moved from the said starting point to the said finishing point; and a plurality of sets of cards, each card of each set defining pictorially the relative first point and second point of one move of a marker from a first position of the marker with respect to the grid to a second position of the marker with respect to the grid, each set of cards being adapted to correspond to a different category of a plurality of categories of move.

Preferably, each card displays a two dimensional grid.

The relative first point and the second point may be defined by one or more vectors and the categories may correspond to categories of clubs or shots to be played in the game which may each be defined by a range of magnitude.

Advantageously, the game does not use dice to determine the distance move of a player but, instead, utilises sets of cards wherein each card defines a shot to be played. A player will hold a number of these cards in his hand at any point in the game and is thus able to select a shot to be played at each turn. The game therefore incorporates the possibility of a high level of skill by the player when deciding which shot to play.

Typically, the playing surface is divided into a plurality of playing areas corresponding to holes to be played during the game. In a preferred arrangement, there are plurality of markers, one for each player in the game; 18 playing areas on the playing surface each corresponding to a hole in the game; the starting point is the starting tee and the finishing point is the hole; the categories of moves correspond to different clubs, different irons or putters; further ancillary cards are provided corresponding to further chance elements in the game such as bunker or rough cards; and each card defines a possible shot to be played.

BRIEF DESCRIPTION OF THE DRAWINGS

The invention will now be described, by way of example, with reference to the accompanying DRAWING which shows a plan view of the game in accordance with the present invention.

DETAILED DESCRIPTION OF THE INVENTION

Figure 1:
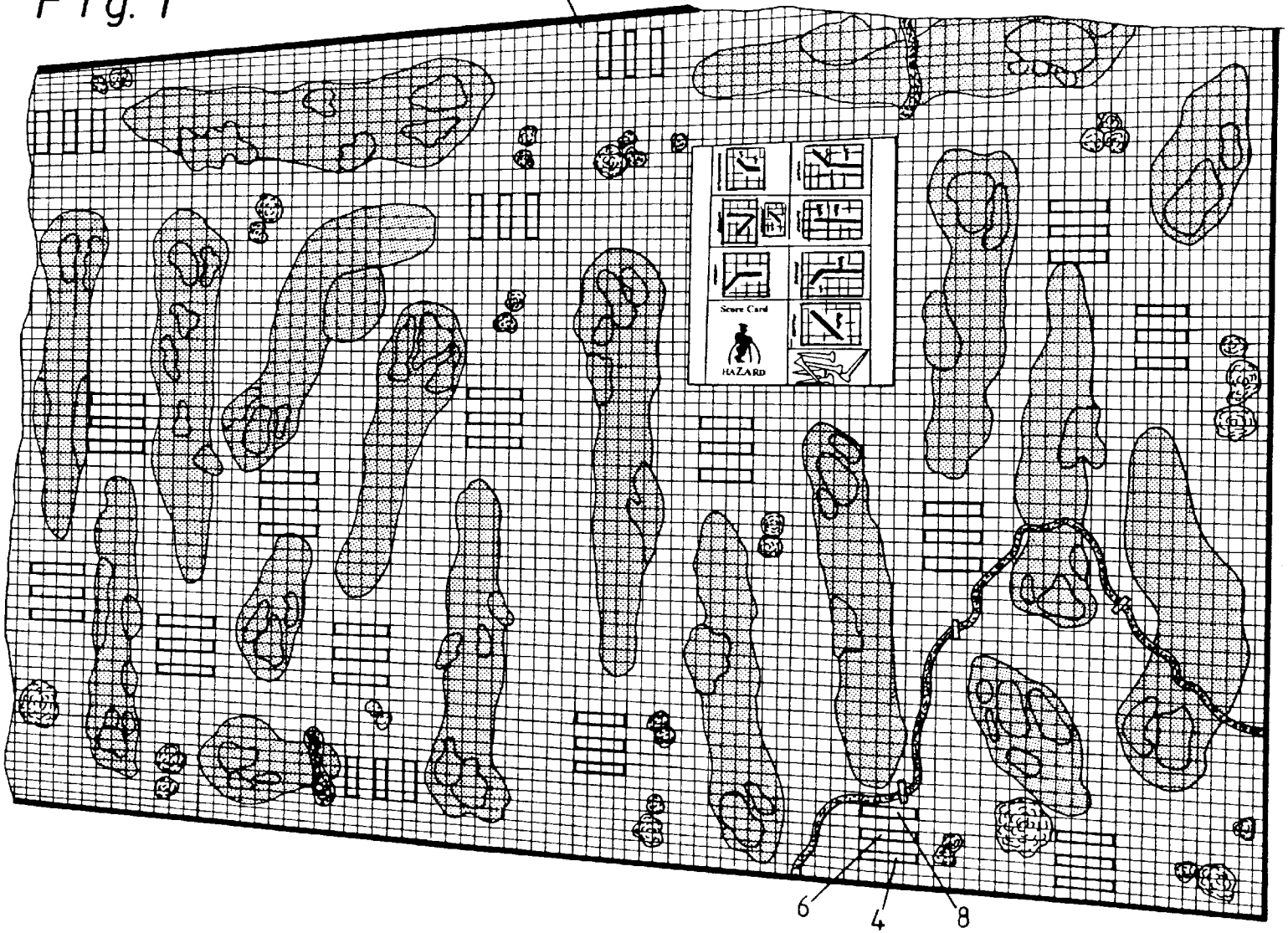
Figure 2A:
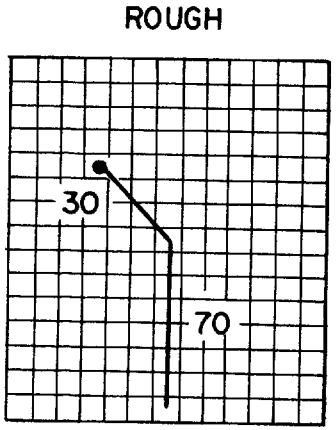
Figure 2B:
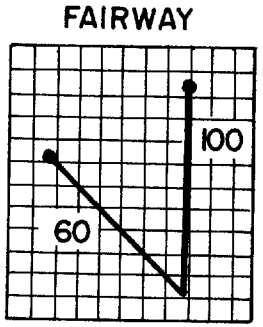
Figure 2C:
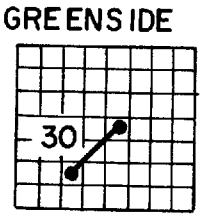
Figure 2D:
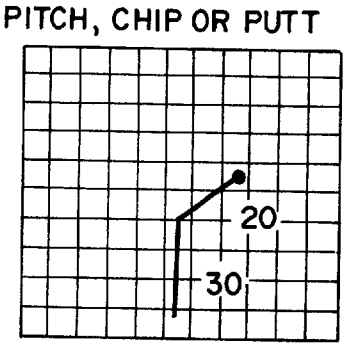
Figure 2E:
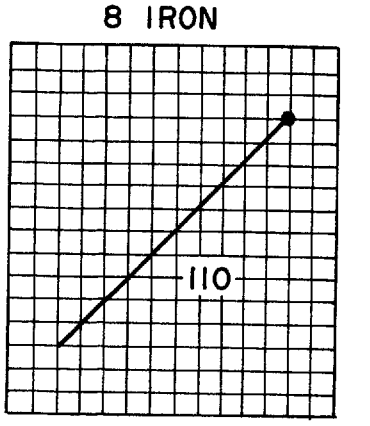
Figure 2F:
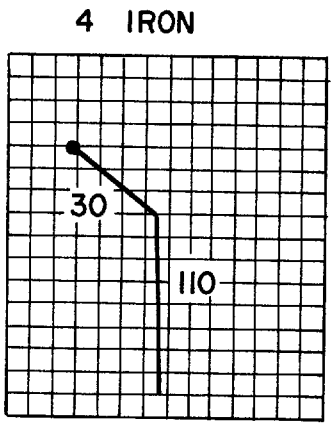
Figure 2G:
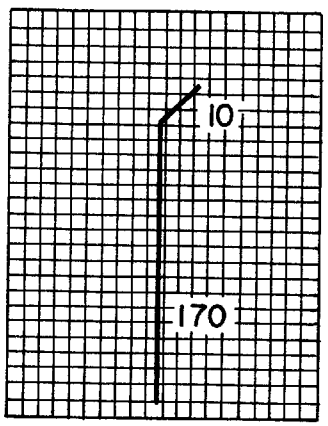
Figure 2H:
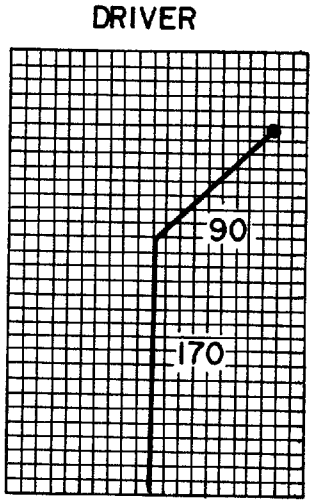

Referring to the DRAWING, a game board has a plain surface with a pictorial representation of an 18 hole golf course and a grid which covers the said course with a series of equally spaced lateral and longitudinal lines. Each hole on the course has three tee off points 4, 6, 8 representing championship, ordinary and ladies tees. Each player progresses around the course using his marker which is in the form of a tee. As with outdoor golf, the object of the game is to complete each hole with the lowest possible number of shots. Before each hole is played, a player selects a set of cards from a multiple compartment card holder which is located in a recess in the middle of the board. Seven sets of cards are provided corresponding to different types of clubs and/or shots to be played. The sets correspond to:

Woods, long irons, mid irons, short irons, putters, bunker cards and rough cards.

At the start of each hole each player selects one club card from each of the five sets and upon his turn he may play the shot of his choice. Each card gives at least one vector of magnitude and direction to be moved from the player's starting point. Cards are also provided which give a choice of shots in different directions or hooked, sliced etc shots which moves the marker in one direction for a number of spaces and then in a second direction for a further number of spaces. Movement may be in any direction including diagonal movement. The player selects what he believes to be his best shot and plays it leaving the card face upwards in front of his position so that the shots played can be added together at the end of the hole. Once a player reaches the green, the square which he occupies contains a number which gives the number of shots necessary to complete the hole. The player then adds this amount to all his card shots and marks them off on his score card. However, if the player can play a pitch-chip-putt card to move to a square which saves him a shot or more he may do so. One square in the green area represents the hole itself and if the player lands on this square no further shots are added to his card tally.

If a player lands on a bunker area or of f the fairway in the rough area then he selects a card from the bunker or rough set and subsequently plays the card. The rules of the game allow some variation in the playing of rough cards but a bunker card must always be played after a player has landed in the bunker. The rules of the game are as follows:

THE PIECES

Markers

Each player, or team of players, has a coloured "tee" which is used to plot their way around the board.

Cards

There are five packs of club cards; woods, longs irons, mid-irons, short irons, pitch-chip-putt, and two packs of hazard cards; bunker and rough cards and stroke cards.

Score cards

SET UP

The packs of cards are placed face-down in their holders on the board. Each player is dealt one of each club card and chooses a marker. To decide who is to start, a tee should be dropped and the player to whom it points shall go first.

PLAY

Teeing off

Players should agree before the start of play which tees, eg White (Championship), Yellow or Red, they will use. This may not be changed during a round. See Handicapping to increase difficulty of play.

THE FIRST SHOT

The first player places his marker on the tee of the first hole. He then chooses one of the cards in his hand to be his "shot". This card is placed face up on the board. The grid lines on the card must be aligned with those on the board. This means that any shot may be played in one of four directions. The player on his left then moves the marker accordingly.

Once a card has been placed on the board it may not be retrieved or adjusted. A player may not move his own marker or "tap out" his prospective shot on the board prior to playing a card.

The player then places the card face up in front of him to create his own discard pile which will be used to keep track of the number of strokes on this hole. The player must then replenish his hand with a club card of the same kind as that just played, taking from the top of the pile whilst discarding the used cards on the bottom of the appropriate packs. Five cards will be held at all times.

If the ball has not landed on the green then play passes to the player on the left and continues to do so until all have played one shot from the tee. After this it is always the player furthest from the hole who goes next.

On hitting the green, a player continues until he has holed the ball.

THE SECOND SHOT

The player furthest from the hole goes next.

If the ball is on the fairway then he plays a club card as normal.

If the ball is not on the fairway in play, on the green, or in a hazard, then he may do one of two things:

a) play the top card of the rough pile; or b) play a card from his hand at a stroke penalty.

This card then counts as two shots and should be placed on the player's discard pile FACE DOWN to indicate this when scoring.

If the ball is in a bunker then the top card from the bunker pile must be played.

Where a square contains both hazard and fairway, arrows marked on the board indicate the area in which the ball is deemed to have landed.

GREENS

Each square on the green has a number on it representing the number of putts you take to get down the hole. This number is added t o the number of cards in his hand. For example, a player on a "three" Square may have a pitch-chip-putt card which puts him on a "one" square so saving him one stroke.

ADDITIONAL

A player may decide that he does not hold a suitable club card in this hand and he may, for no penalty, take the top card from any club pack and play this instead. This card MUST be played immediately—the player may not change his mind and play one from his hand.

CONTINUATION OF PLAY

The player with the lowest score for that hole "has the honour" and tees off first on the next hole with the others following according to their previous hole score.

WINNING THE GAME

The player with the lowest total score is the winner.

GENERAL NOTE

Play should be continuous with each player making their shot as soon as the previous player has finished theirs.

COMMON QUESTIONS

Q. My shot takes me off the board. What happens?

A. You have played "out of bounds". The stroke card is added to your discard pile face down (to indicate that it counts as two shots; one stroke and one penalty) and the shot must be played again. "Out of bounds" areas are marked by the small white circles on the board and can be seen to indicate the Club House area as well as the boundaries of the board itself.

Q. My ball has landed in a tree. Does this incur a penalty?

A. All trees are in the rough and so no further penalty is incurred. Rough rules apply (see above).

Q. My ball has landed on a green other than the one I was playing for. Is this still counted as rough?

A. As noted on the back of your score card everything off the "fairway in play" is deemed rough. However, the rules of golf apply and you must move your marker to a rough square next to the green, no closer to the hole you are playing for. This also applies if you land on a tee square.

Q. My ball has landed in a bunker which is on another hole. Can I play a bunker card instead of a rough card?

A. No. It is not on the fairway in play and so is deemed rough. Play it from where it lands in accordance with the rough rule above.

HANDICAPPING

Inevitably some players will be far better at this game than others and so handicapping may be applied to them to create a more balanced game.

It is generally easier to get a low score from the red "ladies" tee than from the yellow "means" or even the hard white "professional" tees, and so a more experienced player can be handicapped by teeing off from one of the further tees.

A harsher handicap would be to limit the "numbered" tee squares from the number two square on the professional tee on each hole. (N.B. While the white tees are all harder than the red or yellows the individual number squares within the white tee area are of similar difficulty and it is only the limiting of choice which increases the handicap.)

This makes achieving a low score very hard indeed but does form the basis for a very competitive game as outlined in the Pro Game below.

HEAD START—NOT HANDICAP

If handicapping a particular player to make an even game with a less experienced opponent makes the game too hard for the handicapped player, an alternative is to let the beginner play with an advantaged hand.

Option 1: At the end of the first nine holes a player must discard and replace their entire hand.

Option 2: An upper limit of eight strokes per hole is set, after which any further shots on a hole do not count towards a player's score.

Option 3: Two of each stroke cards are held for each hole (10 card in all). Cards are played and discarded as above but replacement cards are only taken on completion of a hole.

PRO GAME

This game is played from the white tees only.

At the start of the game each player chooses a numbered white tee square from which all tee shots will be played (e.g. the number "3" square) and then takes any ten cards from the club packs to make up a hand. One player may use the same tee number as another player but no player may change their allotted square number once play has commenced.

Cards are played and discarded as normal and the hand is replenished immediately. The replacement card need not be of the same type as that Just played.

This version calls for a structured approach to the game and with its scope for club choice can allow for skilful players of similar ability to reduce the luck element of the game to create a very even playing field. It should not, however, be used in conjunction with any of the above games or option.

STANDARD GAME VARIATIONS

Rather than simply playing for the lowest score on a round a number of alternatives are available to the players. These range from simply pairing up as partners and using combined totals, to some far more esoteric games where a pocket computer would be needed by most just to keep track of what is going on. Outlined below are a few of the more common variations. Please remember that these are only suggestions and may be amended, added to, or omitted.

Strokeplay This is the basic "lowest score" golf.

Foursome Partners take alternative shots. (Players may not use cards from their partner's hand!) Teeing off within a pair is alternative.

Matchplay Each hole is scored individually with the winning player or pair scoring one point. Tied holes are halved.

Betterball Played in pairs with only the best score between partners counting on each hole.

Side bets are often seen as an integral part of a round of golf. Generally they are for small amounts and can keep the game alive for a player even when he is a long way behind on the score card.

All of the following are scored separately from the main play. They are side bet scores and do not affect stroke scores at all.

In each example below points have been used to keep track of the gamble. It is up to the players to agree a monetary value to apply to these points.

Snakes and Camels

Every time any player 3 putts, one point is added to the snake fund and this player then "carries" the snake until another player snakes a putt.

Every time any player lands on a bunker, one point is added to the camel fund and this player then "carries" the camel until another player lands in a bunker.

The player carrying the snake at the end of the round must pay each of the other players the amount in the snake fund and the player carrying the camel must do likewise with that fund.

LONG SHOTS

Each hole is worth its yardage in points. Thus a 475 yard hole is worth 475 points. Tied holes should have half their yardage carried forward and added to that of the next hole.

These are but two examples, but points may be given for the longest drive to hit the fairway (or green) on each hole; for single putts; hitting the green from a bunker etc.

THE CLASSIC GENTLE—SKINS

Long shots is a side bet variation of "Skins". This is basically a matchplay game where each hole is worth a set amount of money and the winner of each hole has that amount added to his pot. Tied holes have their full value carried forward. This means that if players tie three holes in a row then the fourth hole will be worth four times the basic hole prize. Amounts not won by the end of the round can either go by the way or can then be played for in a sudden death on as many extra holes as it takes to produce a winner. These extra holes do not add to the pot. It can be seen from this that a player may win only one hole in the round, but so long as that win comes after a number of ties, then their final pot may be the largest. When more than two players are competing, a hole need only be tied by two of them for the pot to be rolled on to the next hole where all players may again attempt to win.

An alternative version of this is where tied holes are not carried forward. This is called aptly enough "Chicken Skins".

It is envisaged that various to the games will include variations in the layout of the course and design of the holes. In particular, it is expected that games may be custom made for particular well known courses and the layout of such a board would mimic the layout of the well known course.

I claim:

1. A golf game comprising: a playing surface, the said playing surface having at least one playing area comprising a starting point, a finishing point and a two dimensional grid defining a plurality of grid references on the playing area incorporating the said two points; at least one marker operable to be moved from the said starting point to the said finishing point; and a plurality of sets of cards, each card of each set comprising a two-dimensional grid corresponding with grid references of said plurality of grid references on the playing area, each card defining pictorially the relative first point and second point of one move of a marker from a first position of the marker with respect to the grid references of the playing area to a second position of the marker with respect to the grid references of the playing area when the grid references of the card are aligned with the grid references of the playing area, each set of cards being adapted to correspond to a different category of a plurality of categories of moves.

2. A golf game as claimed in claim 1, wherein the relative first and second point are defined by a single vector.

3. A golf game as claimed in claim 1, wherein the relative first and second point are defined by two or more vectors.

4. A golf game as claimed in claim 1, wherein the different categories of move correspond to different categories of clubs or shots to be played in the game.

5. A golf game as claimed in claim 1, wherein the categories are each defined by a range of magnitude of moves to be played.

6. A golf game as claimed in claim 1, wherein the playing surface has a plurality of playing areas.

7. A golf game as claimed in claim 1, wherein there are a plurality of markers.

8. A golf game as claimed in claim 1, wherein sufficient cards are provided to allow a player to hold a plurality of cards at least one from each set at each turn of the game.

9. A golf game as claimed in claim 1, wherein there are 18 playing areas on the playing surface.

10. A golf game according to claim 1, wherein each playing area corresponds to a hole in the game.

11. A golf game according to claim 1, wherein the starting point is the starting tee and the finishing point is the hole.

12. A golf game according to claim 1, wherein the categories of move correspond to woods, long irons, short irons, mid irons or putters.

13. A golf game according to claim 1, wherein further ancillary cards are provided corresponding to further chance elements in the game.

14. A golf game according to claim 1, wherein the ancillary cards correspond to bunker or rough cards.

15. A golf game as claimed in claim 1, wherein each card defines a possible shot to be played.

* * * * *

UNITED STATES PATENT AND TRADEMARK OFFICE

CERTIFICATE OF CORRECTION

PATENT NO. : 5,908,192

DATED : June 1, 1999

INVENTOR(S) : West

It is certified that error appears in the above-identified patent and that said Letters Patent is hereby corrected as shown below:

Column 2 Line 42, please delete " If a player lands on a bunker area or of f the fairway in the " and insert therefor

--If a player lands on a bunker area or off the fairway in the --

Column 3 Line 45, please delete " number is added t o the number of cards in his hand. For " and insert therefor

-- number is added to the number of cards in his hand. For --

Column 4 Line 25, please delete " "ladies" tee than from the yellow "means" or even the hard " and insert therefor

-- "ladies" tee than from the yellow "mens" or even the hard " --

UNITED STATES PATENT AND TRADEMARK OFFICE

CERTIFICATE OF CORRECTION

PATENT NO. : 5,908,192

DATED : June 1, 1999

INVENTOR(S) : West

It is certified that error appears in the above-identified patent and that said Letters Patent is hereby corrected as shown below:

Column 4 Line 61, please delete " of the same type as that Just played " and insert therefor -- of the same type as that just played --

Signed and Sealed this

Ninth Day of May, 2000

*Attest:*

*Attesting Officer*

Q. TODD DICKINSON

*Director of Patents and Trademarks*